US005167412A

United States Patent [19]

Rochefort

[11] Patent Number: 5,167,412

[45] Date of Patent: Dec. 1, 1992

[54] AUTOMATIC PIN SETTER

[76] Inventor: Lucien Rochefort, Parc Colbert, 2425, Watt Street, Sainte-Foy, Québec, Canada, G1P 3X2

[21] Appl. No.: 761,708

[22] Filed: Sep. 18, 1991

[51] Int. Cl.[5] ..... A63D 5/08

[52] U.S. Cl. ..... 273/43 A; 273/44

[58] Field of Search ..... 273/44, 54 C, 43 A; 364/411

[56] References Cited

U.S. PATENT DOCUMENTS

| | | | |
|---|---|---|---|
| 3,458,191 | 7/1969 | Murdoch et al. | 273/44 |
| 3,480,279 | 11/1969 | Ingebo | 273/44 |
| 3,778,057 | 12/1973 | Leidl | 273/44 |
| 3,941,379 | 3/1976 | Paule et al. | 273/44 |
| 4,754,967 | 7/1988 | Edler et al. | 273/54 C |
| 4,911,449 | 3/1990 | Dickinson et al. | 364/411 X |

FOREIGN PATENT DOCUMENTS

| | | | |
|---|---|---|---|
| 1164905 | 4/1984 | Canada | 273/44 |

*Primary Examiner*—Vincent Millin
*Assistant Examiner*—William M. Pierce
*Attorney, Agent, or Firm*—Pierre Lespérance; Francois Martineau

[57] ABSTRACT

In a bowling game, an apparatus to automatically retrieve knocked down tenpins from the skittle alley, after each ball strike aimed thereat. The apparatus includes a series of cables each connected to the head of a corresponding one of the tenpins. The cables are connected to a computer controlled slider, guidingly carried by a horizontal rail and power driven in reciprocating motion by an endless belt. Once at least one tenpin is struck by a ball, all tenpins are lifted by their cables through actuation of the motor of the power driven endless belt. The slider then returns to its initial position, which will enable the cables to yield to the weight bias of their pins and therefore allow all of the latter—but for the knocked down tenpin—to fall back to their upstanding position on the skittle alley. The knocked-down pin has been identified by optical sensors connected to the computer, and the computer will have actuated a cam-type cable lock to prevent release of the knocked down pin cable under the weight of this latter pin.

2 Claims, 9 Drawing Sheets

AUTOMATIC PIN SETTER

FIELD OF THE INVENTION

This invention relates to the game of bowling, and particularly to apparatuses that remove knocked down tenpins from the skittle alley after each ball strike on the bowling alley.

BACKGROUND OF THE INVENTION

In the game of bowling, heavy spherical balls are rolled down a lawn or an indoor alley and targeted at a set of wooden clubs called pins, usually a triangularly positioned set of ten pins (called tenpins) standing upright on a skittle alley at the rear end of the bowling alley, in an attempt to knock them down. Experts are often able to strike all tenpins in a single ball shot, but laymen will usually be able to knock down only a fraction of the total number of pins. A player may, according to bowling game rules, try at least a second time to knock down the pins that remain upstanding on the skittle alley. In order to ensure that the knocked down pins from the first ball shot do not interfere with those unstruck pins that remain upright on the skittle alley, it is necessary to remove the knocked down pins from the skittle alley area, after each ball throw.

Known systems for segregating the knocked down pins from the unstruck pins, consist of a large perforated partition, extending horizontally above the skittle alley and movable vertically thereabout through power means. After each ball throw, the partition is lowered, to engage and temporarily secure the heads of the pins that remain in upstanding position, and then lifted, bringing therewith the pins. The knocked down pins, which were not captured by the moving partition, will be then cleared from the skittle alley by a mechanical means, for example a horizontally sliding rake skimming the surface of the skittle alley toward a rear skitte pit, for discharge of the knocked down pin therein. The partition will then be lowered once again to release the remaining pins in their original upstanding position in triangular arrangement.

Such known systems are not efficient, because of the complexity of the pin removing and setting system.

OBJECTS OF THE INVENTION

The gist of the invention is to increase the efficiency of automatic pin setters in bowling games.

An object of the invention is to provide an automatic, computer based system for registering the points obtained by a player successful in targeting with his balls at least some of the tenpins.

SUMMARY OF THE INVENTION

Accordingly with the objects of the invention, there is disclosed an apparatus in a bowling game to automatically retrieve knocked down tenpins from the skittle alley, after each ball strike aimed thereat. The apparatus includes a series of cables each connected to the head of a corresponding one of the tenpins. The cables are connected to a computer controlled slider, guidingly carried by a horizontal rail and power driven in reciprocating motion by an endless belt. Once at least one tenpin is struck by a ball, all tenpins are lifted by their cables through actuation of the motor of the power driven endless belt. The slider then returns to its initial position, which will enable the cables to yield to the weight bias of their pins and therefore allow all of the latter—but for the knocked down tenpin—to fall back to their upstanding position on the skittle alley. The knocked-down pin has been identified by optical sensors connected to the computer, and the computer will have actuated a cam-type cable lock to prevent release of the knocked down pin cable under the weight of this latter pin.

More specifically, the invention consists of a pin setter for a game of bowling in which a number of pins upstanding on a skittle alley flooring are targeted by a ball thrown thereat rollingly along a bowling alley, said pin setter comprising: (a) a main fixed frame; (b) a number of flexible cables, each cable connected at one end to a corresponding one of said pins and at the other end to said main frame at an anchor member; (c) cable pulling means, to pull said cables and associated pins away from a first, skittle alley standing position, to a second, skittle alley clearing position; (d) resetting means, for returning at least some of said pins from their second to their first position, upon deactivation of said cable pulling means; and (e) cable lock means, deactivating said resetting means selectively only for those pins which were knocked down by the ball throw exclusively of those pins which were still standing on the skittle alley flooring after the ball throw.

The invention is also directed at an automatic pin setter for use with bowling game pins at which balls are thrown, comprising: (a) a number of cables, one for each pin of the bowling game and connected at a lower end to their corresponding pin and at an upper opposite end to an anchor means wherein the pins are hung to the anchor means above ground; (b) cable pulling means, to pull said cables and associated pins away from a first, ground standing, upright position, to a second, ground clearing, pin lifted position; (d) resetting means, for returning at least some of said pins from their second to their first position, upon deactivation of said cable pulling means; (e) cable lock means, deactivating said resetting means selectively only for those pins which are knocked down by a ball throw exclusively of those unstruck pins which are still in upright position after the ball throw; and (f) computer means, to correlate said cable pulling means, said resetting means and said cable lock means to enable said cable lock means to segregate those cables of knocked-down pins from those cables of non knocked-down pins; wherein said pin setter is accordingly an automatic pin setter.

DETAILED DESCRIPTION OF THE INVENTION

Figure 1:
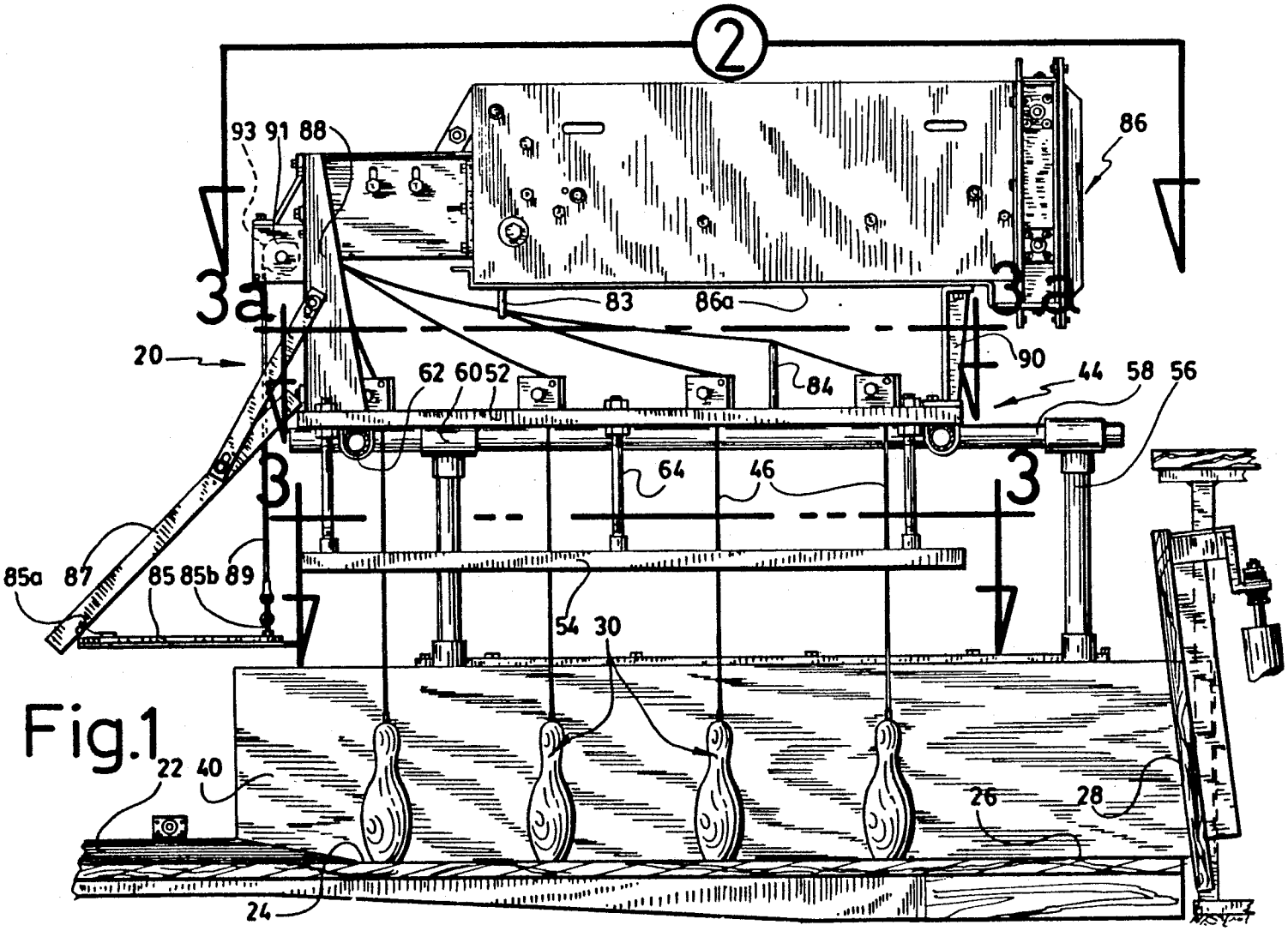
FIG. 1 is a side elevational view of a skittle alley, showing the bowling pins in their operative upright positions and cable-connected to an automatic pin setter apparatus according to the invention.

Bowling game 20 illustrated in FIG. 1 conventionally includes a ground-supported elongated bowling alley 22 (the rear end thereof only being shown), a skittle alley 24 coextensive with and downwardly offset from the rear end of the bowling alley 22, a skittle pit 26 downwardly offset and rearwardly depending from the skittle alley 24, and a ball dampening, forwardly upwardly inclined wall 28, transversely closing the rear end of skittle pit 26. Pins 30 are to be positioned in spaced apart, upright positions on the skittle alley 24, in the known triangular arrangement. Pins 30 are usually enlongated wooden clubs with a shaped contour, defining a large ovoidal base 32 (FIG. 5), a smaller ovoidal head 34, and a restricted neck 36 between the base and head. Base 32 defines a flat circular underface or seat 38, within a plane generally orthogonal to the lengthwise axis of club 30 for supporting same in stable upright position over the horizontal skittle alley flooring 24. Head 34 defines a free end tip 34*a*, located within the lengthwise axis of club 30. Opposite upright partitions 40 are also usually mounted edgewisely of skittle alley 24 and skittle pit 26.

Figure 9:
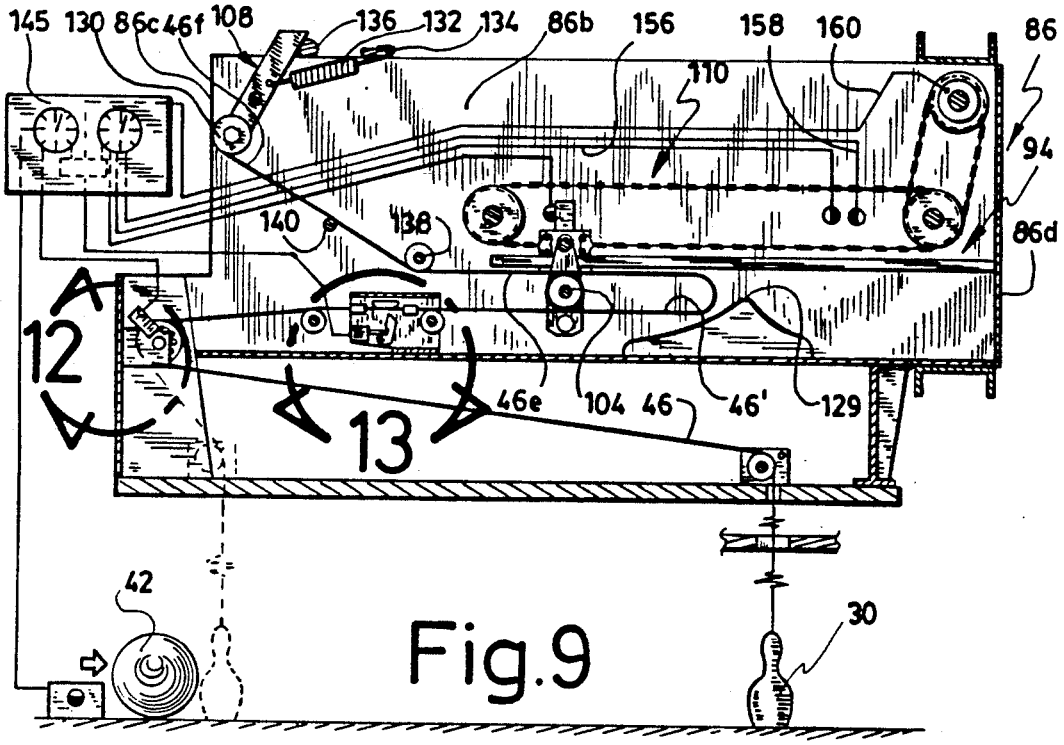
FIGS. 9–9*a* are sectional views taken along lines 9—9 of FIG. 2, sequentially suggesting how the automatic pin setter is actuated following pin knock down.
Figure 9A:
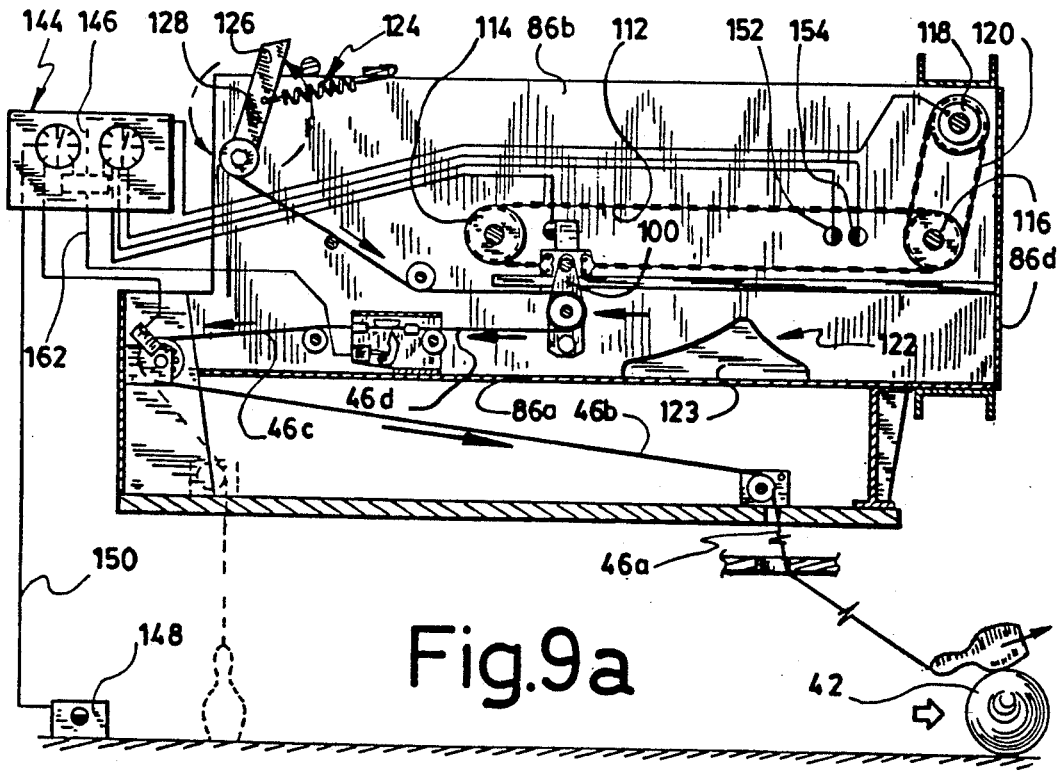

Bowling ball 42 is thrown onto bowling alley 22 toward skittle alley 24, being targeted at pins 30 to try to knock them down in up to three attempts, i.e. to strike at least some of them directly, or indirectly through struck leading pins reactively moving toward trailing pins, to make them fall from their upright positions (FIGS. 1 and 19) to a position laying on their side (FIG. 9*a*). Pins 30 can then gather into pit 26.

According to the invention, means 44 are provided to automatically segregate each knocked down pin 30 within the skittle alley 24, from still upstanding pins, between two ball throws. Pin removing means 44 are fully effective whatever the location of the knocked down pin 30, that is, in the rear pit 26 or even on the skittle alley between still standing pins 30. Moreover, removal of the knocked down pins 30 by said pin removing means 44, after a ball throw, is specifically directed toward positively preventing accidentally knocking down still standing pins 30 during the knocked down pin removing process.

Figure 2:
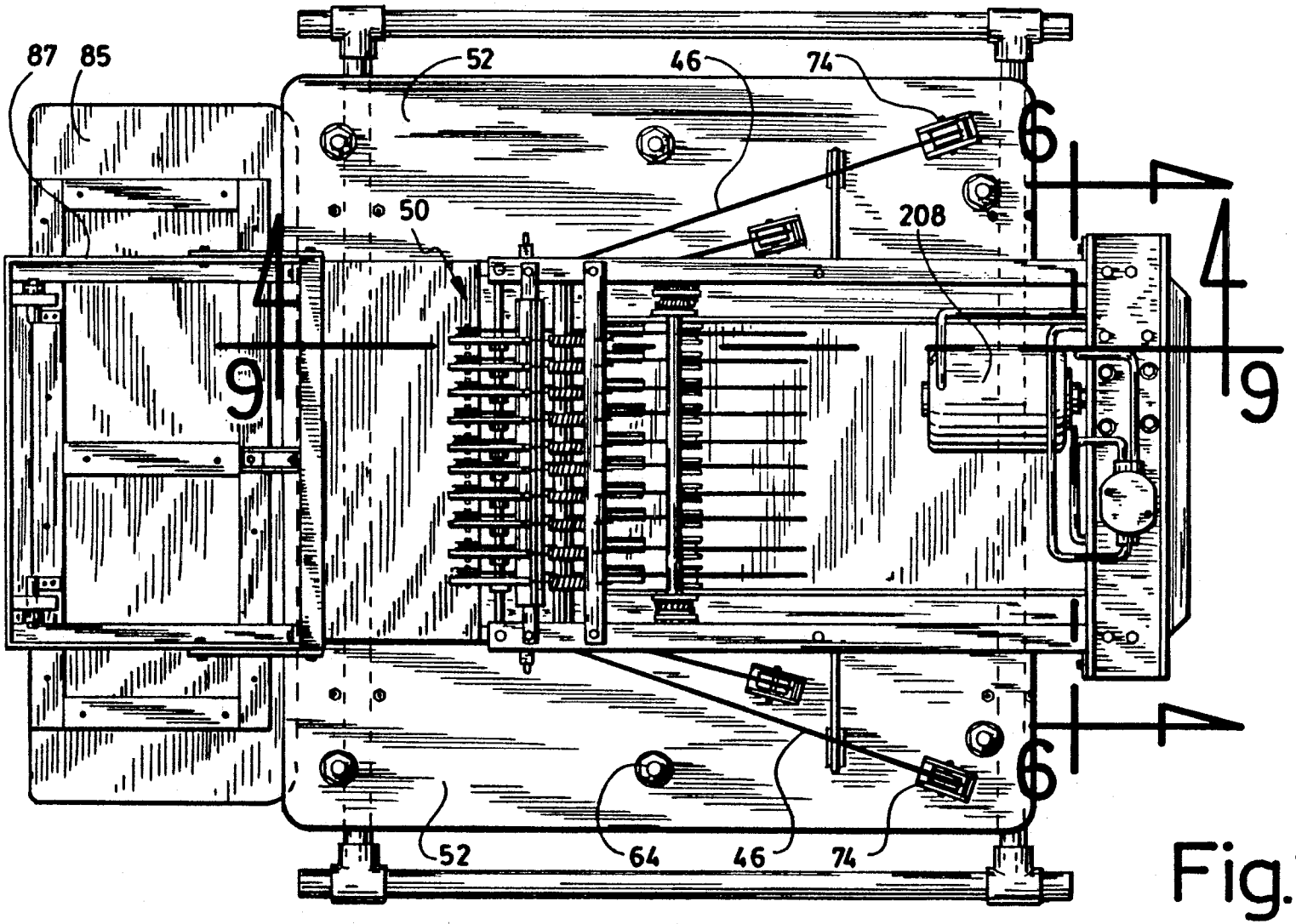
FIG. 2 is a top plan view of the automatic pin setter.

Pin removing means 44 includes a number of flexible cords 46, one for each pin 30 on the skittle 24. Thus, in the game of ninepins, for example, nine cords 46 would be provided; in the game of tenpins, as suggested in FIG. 3, ten cords 46 would be provided. Each cord 46 is anchored at one end into a cylindrical socket 48, axially mounted integrally to corresponding head tips 34*a*. Cords 46 are all connected to a cord-pulling assembly 50 (FIG. 2), detailed later.

Figure 3:
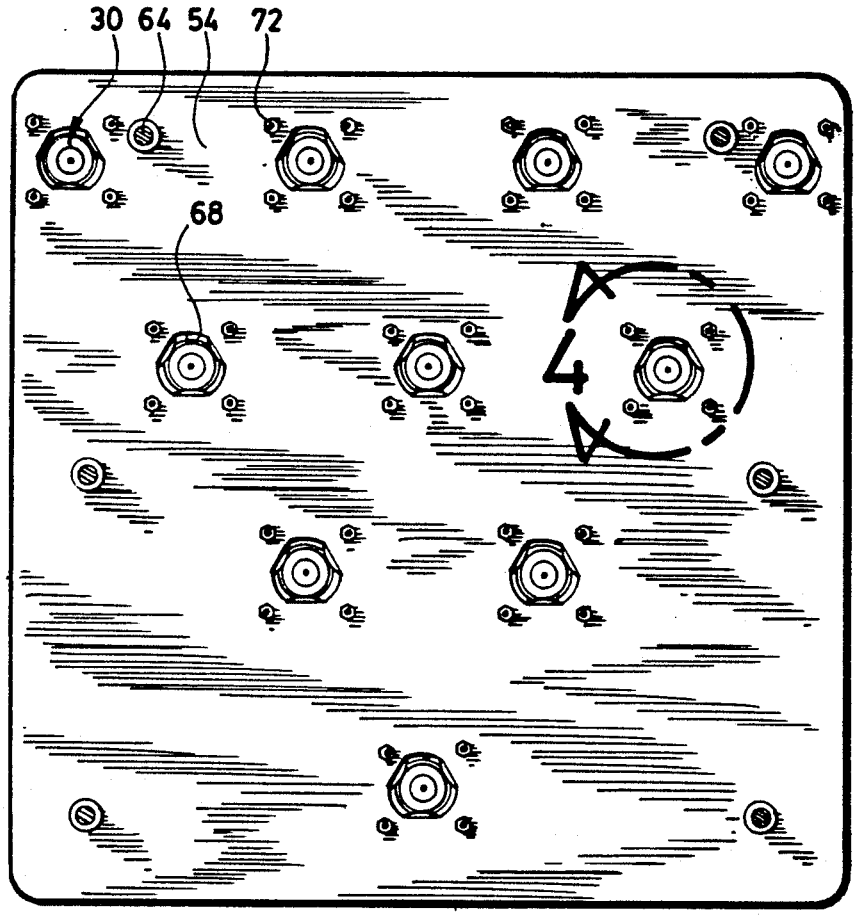
FIG. 3 is a sectional plan view taken along line 3—3 of FIG. 1.
Figure 3A:
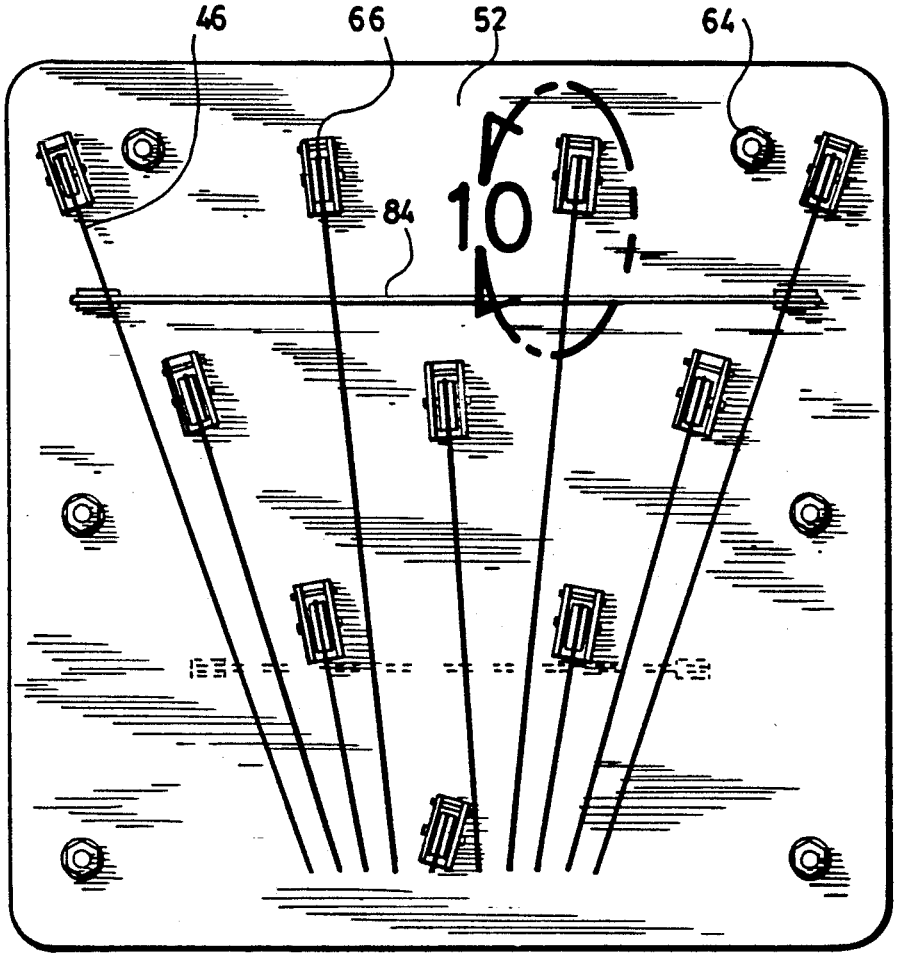
FIG. 3*a*, on the fourth sheet of drawings, in a sectional plan view taken along line 3*a*—3*a* of FIG. 1.
Figure 10:
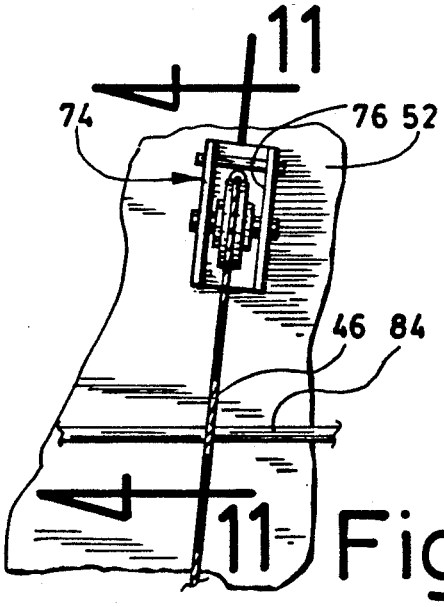
FIG. 10, on the fourth sheet of drawings, is an enlarged view of the area circumscribed by circle 10 in FIG. 3*a;*

As illustrated in FIGS. 1, 3 and 3*a*, two large panels 52, 54 are mounted horizontally above skittle alley 24. Upper panel 52 is anchored to skittle alley side walls 40 by upright posts 56, which stand out from the top edge section of walls 40, and cross-tubings 58, extending edgewisely of panel 52 thereunder and anchored to posts 56 by T-couplings 60. U-brackets 62 engaged by tubings 58 at selected intervals, anchor same to plate 52. Lower plate 54 downwardly spacedly depends from upper plate 52 by vertical bolts 64. Each panel 52, 54 includes a number of through-bores 66, 68 respectively for through passage of a corresponding number of pin cords 46. Through bores 66, 68 are destined to register with one another and with the relative positions of the pins in the underlying set of standing skittles 30, for upwardly guiding cords 46 vertically away from skittle alley flooring 24 during actuation of said cord pulling assembly 50.

Figure 4:
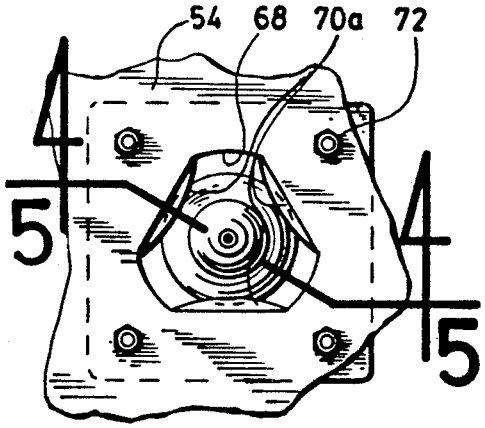
FIG. 4, on the third sheet of drawings, is an enlarged view of the area circumscribed by circle 4 in FIG. 3.
Figure 5:
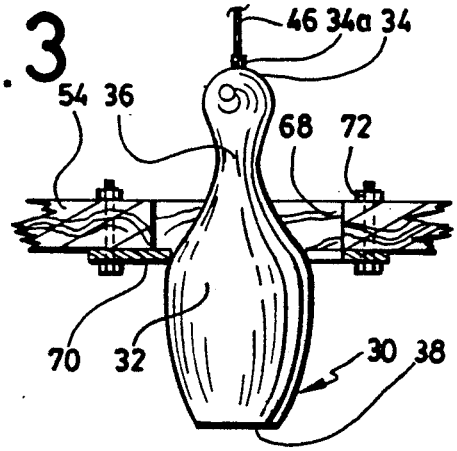
FIG. 5 is a sectional view of a pin in its lifted, skittle alley clearing position, taken along line 5—5 of FIG. 4.
Figure 11:
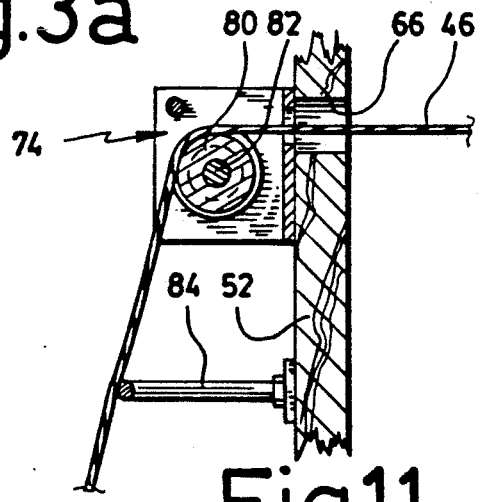
FIG. 11 is a sectional view taken along line 11—11 of FIG. 10.
Figure 6:
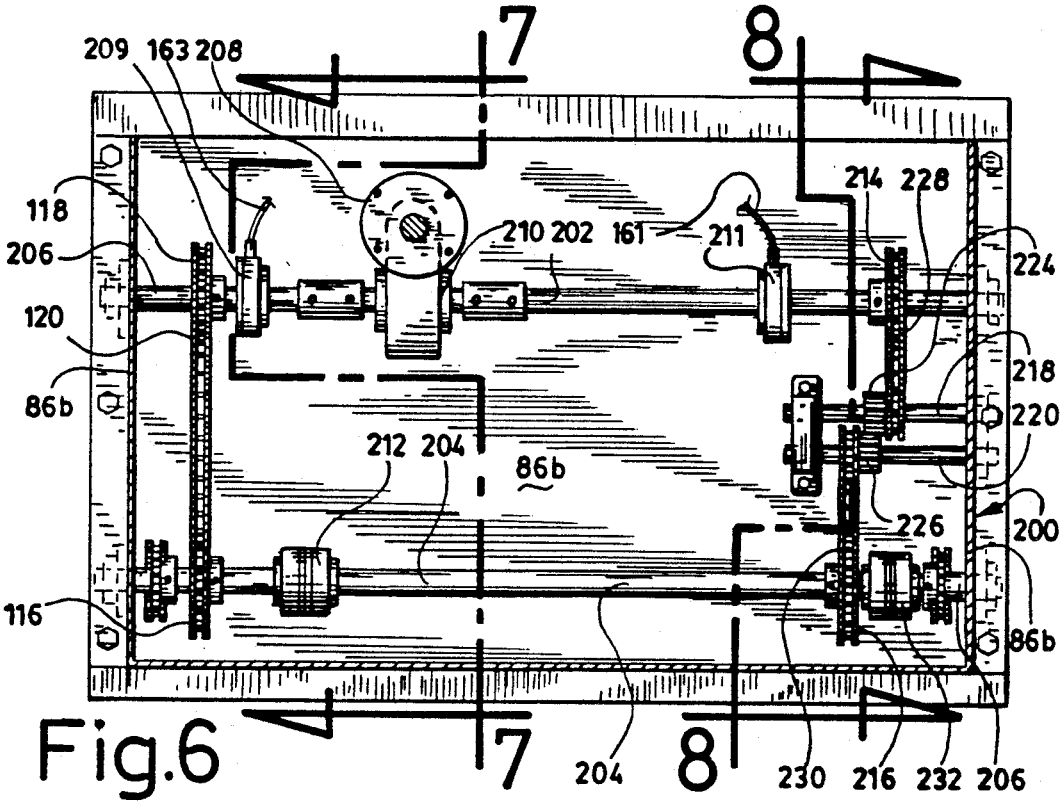
FIG. 6, on the fifth sheet of drawings, is a sectional view taken along line 6—6 of FIG. 2.
Figure 7:
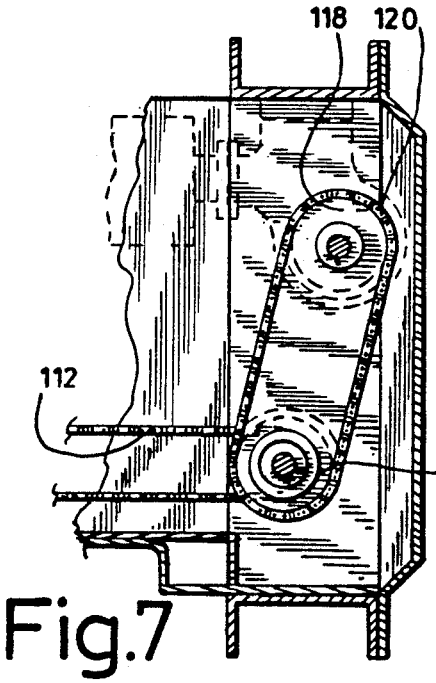
FIGS. 7–8 are sectional views, taken about lines 7—7 and 8—8 respectively of FIG. 6.
Figure 8:
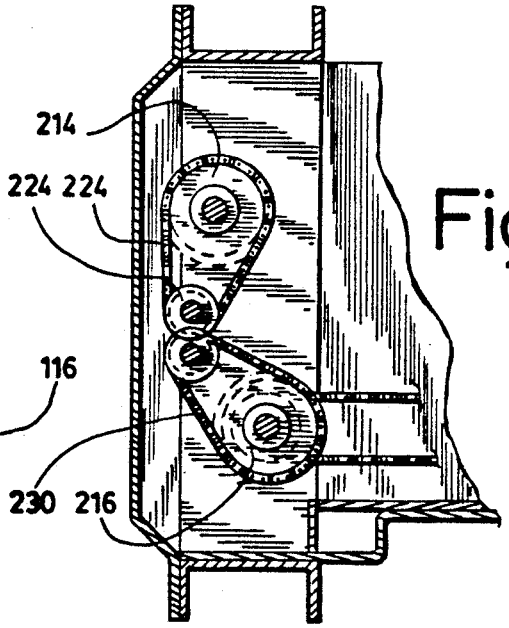

As clearly shown in FIGS. 5 and 11, polygonal aperture 68 is much larger than circular aperture 66, since the former is destined to be engaged by both a cord 46 and at least a portion of a lifted pin 30, while the latter is destined to be engaged solely by a cord 46. The area of large aperture 68 is further restricted by a few arcuate thin plates 70, anchored to plate 54 edgewisely of aperture 68, by bolts 72, with the arcuate section thereof partially projecting at 70*a* within aperture 68, as suggested in FIG. 4. The overall dimensions of thin arcuate plates 70 are carefully studied so as to define a vertical planar circle having a section intermediate the diameter of ovoidal pin parts 32 and 34. That is to say, upon cords 46 being pulled upwardly by pulling means 50, tenpins 30 will be lifted so that their heads 34 and necks 36 all extend upwardly through corresponding, registering apertures 68 of lower plate 54, exclusively of their larger bases 32 which will come to peripherally abut edgewisely against arcuate plates 70. This latter lifted position of each pin 30 defines an upper limit position thereof. Hence, in their upper limit position, each pin 30 will become axially aligned and stabilized by plates 70 within bore 68, against swinging motions. Thereafter, upon release of the pulling means 50, the cords 46 may yield to the weight bias of their end pins 30, and those pins that will be allowed to fall by their own weight (as detailed later) toward the skittle alley flooring 24 will positively adopt an upstanding position onto the skittle alley without any danger of knocking themselves down in the process of reaching ground.

Upper panel 52 carries on its top face a number of yoke members 74 anchored thereto, one for each aperture 66 and in register therewith. Each yoke member 74 defines two opposite, spaced side walls 76, 78 transverse to plate 52 and parallel to the plane of cords 46. An idle pulley 80 is carried by an axle 82 interconnecting the yoke walls 76 and 78. Pulley 80 tangentially registers with bore 66, and is engaged at a right angle sector shape portion thereof by cord 46, wherein the cord 46 is biased into a direction approximately parallel to the plane of panel 52. Yokes 74 are positioned to direct all cords 46 over upper panel 52, to converge toward a common end area as suggested in FIGS. 3*a* and 9–9*a*.

Preferably, U-shape cable tensioning rods 83, 84 are anchored to the under face of flooring 86*a* (see below) and to the top face of upper panel 52, respectively and extending transversely of cords 46 underneath thereof. Cables 46 engage the top edge of lower U-bar 84 and through the U of upper U-bar 83, to provide some measure of basic cord tensioning in order to deter intermingling of cables 46 and therefore possible loops and knots between cables—an undesirable perspective!

Figure 12:
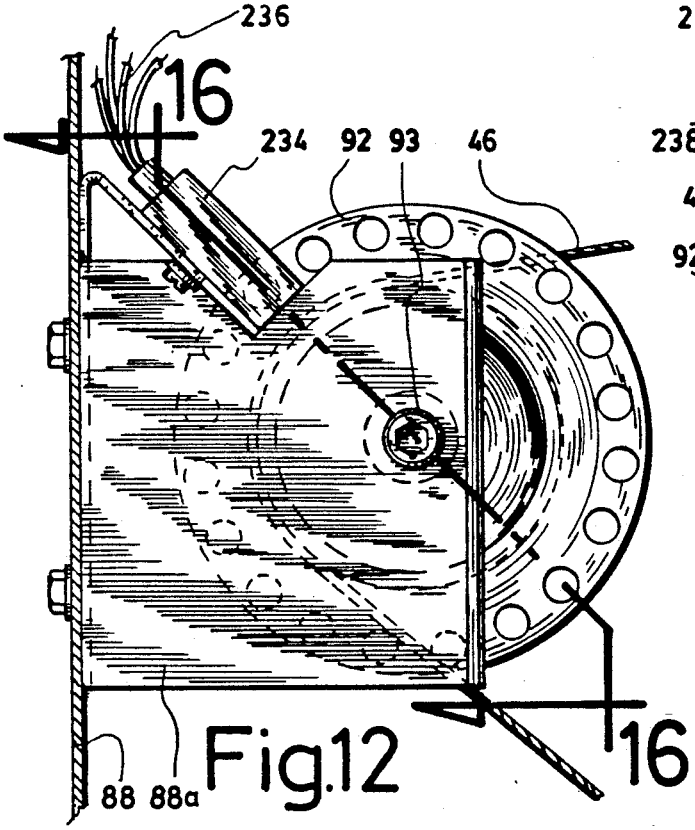
FIGS. 12 and 13, on the eighth sheet of drawings, are enlarged views of the areas circumscribed by circles 12 and 13 respectively of FIG. 9.

As best seen in FIGS. 1, 9–9*a* and 15, a large box-like casing 86 is supported spacedly over upper panel 52 by a large front leg 88 and a smaller rear leg 90, both legs being anchored endwisely to bottom horizontal panel 52 and to the flooring 86*a* of casing 86. Preferably, a flap door 85 is provided to conceal skittle alley 24 and upstanding pins 30 from view by the players of the front end of bowling alley 22, for example when the pins are lifted and reset. Flap door 85 is hinged at its front end 85*a* to the bottom end of a pair of spaced bars 87 which downwardly forwardly depend from front leg 88 of casing 86. The bottom ends of bars 87 are approximately at the horizontal level of the top edge of the skittle alley side walls 40. The opposite rear edge section 85*b* of flap door 85 is connected to a cord 89 which downwardly depend from a winch 91 carried by an upper portion of leg 88 frontwardly thereof, about a yoke 93. By lowering cord 89, door 85 may be pivoted about hinge 85*a* from an inoperative, substantially horizontal position (FIG. 1) to an operative, vertical position where the door bottom (rear) edge 85*b* comes very close to the surface of bowling alley, e.g. about one centimeter. Cord pulling means 50 is mounted within casing 86. Front bracket 88 carries at its top end a number of idle pulleys 92, (FIG. 12) coaxially mounted at 93 to a transverse flange 88*a* of the bracket 88, about an axis parallel to axles 82 of pulleys 80. Pulleys 92 register with an underlying aperture in casing flooring 86*a*, for passage of cables 46. Thus, the legs of cords 46 extending between rearward, downward pulleys 80 and upward, frontward pulleys 92 are forwardly upwardly inclined. Moreover, the latter cord legs are non intersecting, i.e. that each pair of corresponding pulley 80 and pulley 92 engaged by a given cord 46 define a plane that does not intersect the planes of other pairs of pulleys 80 and 92, so as to prevent undesirable entangling of cords 46.

Each pin cord 46 engages a half a turn sector shape front portion of the corresponding front pulley 92, to define a rearwardly directed second cord leg extending within the hollow of casing 86, above the flooring thereof at 86*a*.

Figure 15:
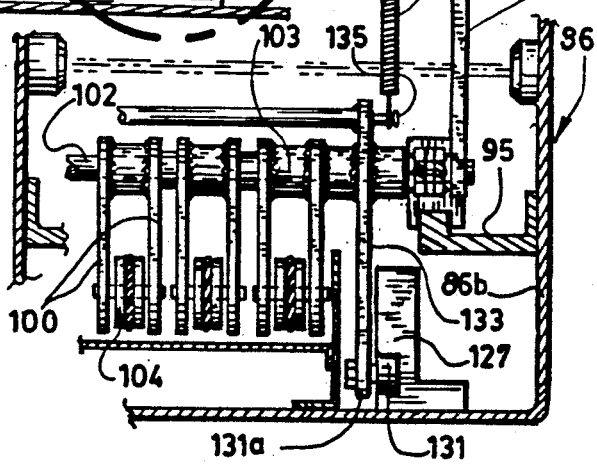
FIG. 15 is an enlarged, partly broken, sectional view taken along line 15—15 of FIG. 9*b;*

A multiple track rail 94 is fixedly mounted to one side wall 86*b* of casing 86, by transverse legs 95 (FIG. 15). Rail 94 extends spacedly and substantially parallel to flooring 86*a* and to the horizontal plane intersecting front pulleys 92 about an intermediate to rear portion of casing 86. A slider assembly 96 is slidingly carried by rail 94 for fore and aft displacement within casing 86, between the front wall 86*c* and rear wall 86*d* thereof. Slider 96 includes a main frame 98 from which downwardly depend a number of arms 100. All arms 100 are pivotally interconnected to main frame 98 by a single, elongated pivot shaft 102. Pivot shaft 102 is transverse to rail 94.

A number of second idle pulleys 104 are carried by the lower ends of the slider arms 100, about pivot axles 106, each pulley 104 in between a pair of corresponding spaced arms 100, 100 (FIG. 15). Each pair of arms 100 are free to pivot about their top pivot axle 102, independently of the other arms 100, being interconnected by a sleeve 103 extending freely around shaft 102.

Each cord 46 is anchored at its end opposite pin 30, to an anchor member 108 (FIG. 9) located at the upper, front portion of casing 86, and fixed to side wall 86*b*. Between the front pulley 92 and front anchor member 108, each corresponding cord section 46 is rearwardly biased by rearward engagement of its corresponding slider pulley 104. Hence, rearward displacement of slider 100 from its intermediate limit position is destined to pull cord 46, and thus associated pin 30, away from flooring 24. The planes of corresponding pairs of pulleys 92 and 104 do not intersect one another, as for the planes of pulleys 80 and 92. Similarly, forward displacement of slider 100 from its rearward limit position will slacken cable 46, thus allowing clubs 30 to fall by their own weight toward flooring 24, drawing therewith the cable.

Power driven means 110 are provided to power displace slider 96 along horizontal rail 94. Drive means 110 includes an endless chain 112, rotatively carried by two idle pulleys 114 and 116, being mounted to frame side walls 86*b*, 86*b*, for fore and aft displacement within a substantially vertical plane. The rear pulley 116 is entrained by a drive axle 118, mounted to the upper rear section of frame 86, and anchored to side wall 86*b*, via a drive chain endless belt coupling 120.

Preferably, damper means 122 are provided, to allow both smooth, slow paced engagement of the pin head 34 through partition wall 52, when slider 96 is displaced rearwardly upon removal of the pins 30 from the skittle alley, as well as smooth, slow paced resetting of the pins on their flat underface 38 onto the skittle alley flooring 24, in their pin upstanding position. Damper means 122 are of the cam type, defining a block unit 123 anchored to the frame flooring 86*a* spacedly underneath an intermediate section of chain 112. Block unit 123 defines an upper surface, having a front portion 125 and a rear portion 127. Front block portion 125 is rearwardly upwardly inclined, while rear portion 127 is forwardly upwardly inclined and merges with front portion 125 at a topmost intermediate tip 129. The slope of rear portion 127 is greater than that of the front portion, but the length of the former is smaller than that of the latter. Both faces 125 and 127 of block unit 123 preferably have a slight, shallow concavity.

Figure 9B:
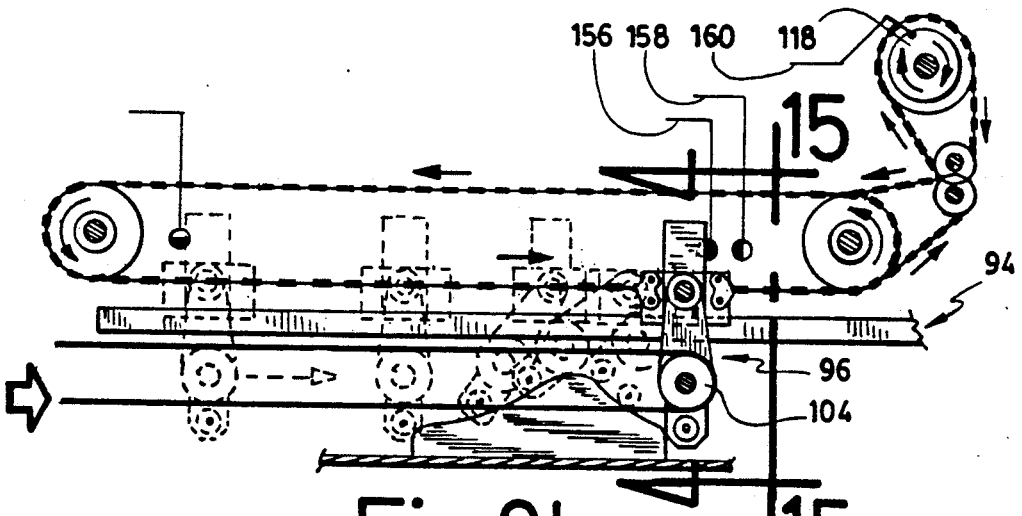
FIGS. 9*b*–9*c* are enlarged views of the chain slider and cam assembly shown centrally of FIGS. 9 and 9*a*, sequentially suggesting how the slider tilts about the fixed cam during the FIGS. 9–9*a* sequence.
Figure 9C:
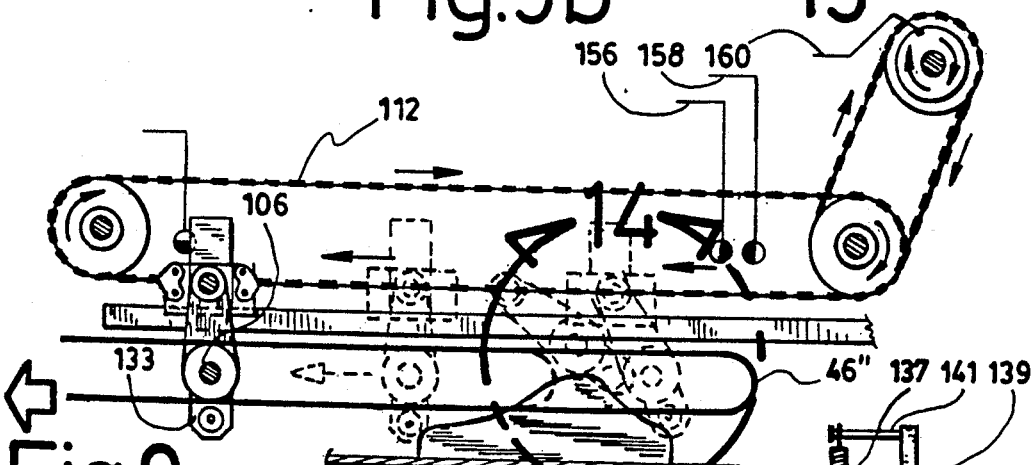
Figure 14:
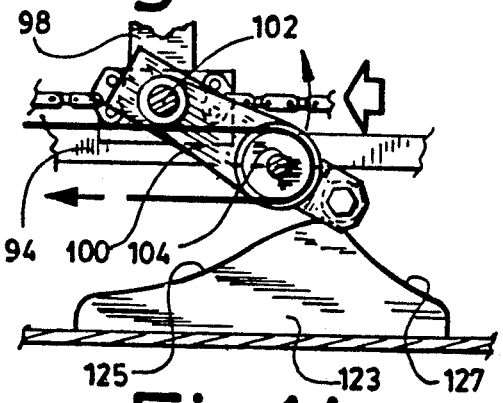
FIG. 14, on the seventh sheet of drawings, is a slightly enlarged view, in full lines, of the elements shown in phantom lines within circle 14 of FIG. 9*c;*
Figure 17:
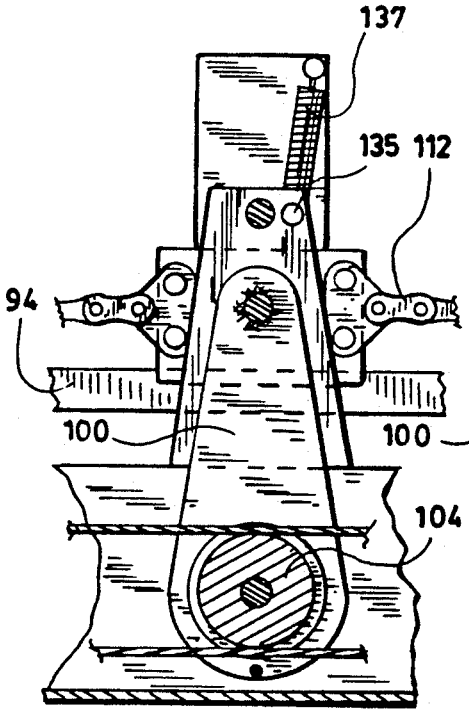
FIGS. 17, 18 and 18*a*, on the ninth sheet of drawings, are enlarged views of the chain driven, cable connected slider illustrated in FIGS. 9*b*–9*c*, sequentially showing the tilting capability thereof about its spring biased upper pivot mount.
Figure 18:
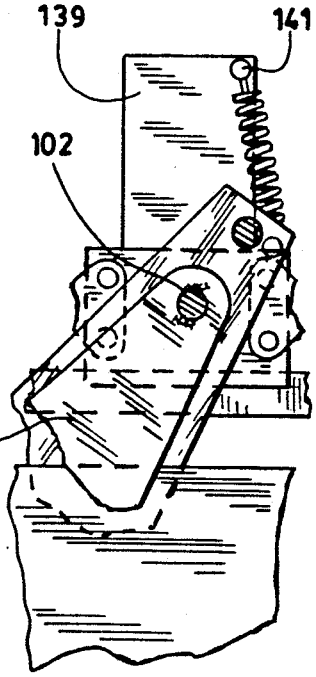
Figure 18A:
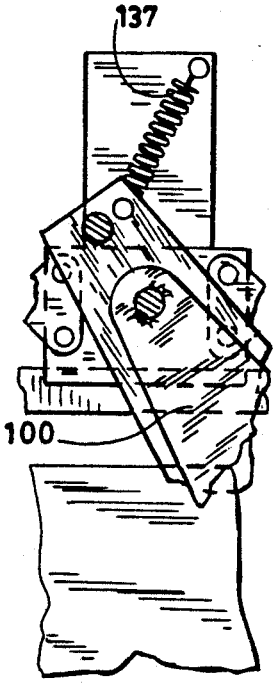

As suggested in FIGS. 9*b*–9*c* and 15, damper means further includes idle rollers 131, each carried by a transverse axle 131*a* at the outer end of a rocker arm 133. Rocker arm 133 is carried by shaft 102 proximate rail 94, at an intermediate section of rocker arm 133. Rocker arm 133 pivots with slider arms 100. When slider arms 100 hang freely onto their shafts 102, rollers 131 come in transverse register with the bottom end of the slope of faces 125 and 127 of block unit 123. The end of rocker arm 133 opposite transverse roller 131 carries a transverse pin 135 hooked to a coil spring 137. An upright post 139 (FIG. 15) is further anchored to shaft 102 outwardly from rail 94 relative to slider arms 100. Since shaft 102 is anchored to walls 86*b*, 86*b*, post 139 is fixed. A transverse inturned pin 141 is mounted to the top end of post 139, wherein coil spring 137 further endwisely engages pin 141 to interconnect rocker lever 133 to fixed post 139. As suggested sequentially in FIGS. 17–18 and 18*a*, the assembly of tilting rocker arm 133 and slider arms 100 will be biased in an upright position (FIG. 17) by coil spring 137, which extends in its unstretched condition.

Upon actuation of drive axle 118, chain 112 is rotated to reciprocate slider arms 100. Upon rolling engagement of the arms end rollers 131 with faces 125 and 127 of block unit 123, the arms 100 will yieldingly tilt pivotally about their top pivot axle 102, and the apparent speed of cable 46, at the level of its arm connected pulley 104, will accordingly decrease in relation to the slope of the faces 125 and 127. During this motion, cable carrying pulley 104—intermediate pulleys 102 and roller 131—clears block 112. Once arm rollers 122 reach the block upper tip 129, pins 30 have either reached their upper limit positions partially engaging perforated plate 52 (FIG. 5), or have returned to their alley standing positions (FIG. 9).

As suggested sequentially in FIGS. 9 and 9*a*, it is understood that, as the pins 30 used as targets for the player having rolled down the ball 32 toward same, are struck, these pins 30 will be reactively displaced rearwardly. Since the pins 30 are anchored to fixed frame 86 by anchor member 108, via elongated, multiple-pulley engaging cables 46, the latter need to yield for the pins to move rearwardly outwardly of skittle alley 24, as is required. Accordingly, biasing means 124 are provided, to enable each cable 46 to be pulled yieldingly with the struck pin 30, yet to be able to automatically return same pin thereafter to an alley overhanging inoperative position shown in FIG. 5 where it engages perforated panel 52. Such biasing means 124 is embodied within anchor means 108 and includes an elongated pivotal lever 126, pivoted at its intermediate section by pivot axle 128 to the upper front portion of frame 86. Pivot axle 128 extends along an axis parallel to that of pulleys 114, 92 and 80 within frame 86. Lever 126 carries at its lower end a pulley 130, around which is fixedly wound the end section of cable 46, and at its upper end one end of a coil spring 132, the latter anchored at its opposite end to fixed frame 86 at an anchor point 134 both above the horizontal plane intersecting pivot 128 and rearwardly of the vertical plane intersecting this same pivot 128.

Lever 126 is free to pivot within casing 86, but for a transverse seat rod 136 integral to frame 86 and located at a position above the horizontal plane intersecting pivot 128 and intermediate the vertical planes intersecting same pivot 128 and spring anchor point 134. Spring 132 therefore biases lever 126 to abut against rod 136, in a rearwardly upwardly inclined fashion (FIG. 9).

Accordingly, when the pin 30 struck by ball 42 pulls cable 46 therewith, lever 126 pivots counterclockwise about its central axle 128, against the bias of spring 132 and away from seat 136, by an angular value whose magnitude is a function of the magnitude of blow of ball 42 against pin 30. Lever 126 could for example reach a vertical limit position, before coil spring 132 can exert its clockwise rotational torque to lever 126. At this vertical limit position of lever 126, slider arm 100 occupies its frontmost position (FIG. 9*a*) and cable 46 is taut around the rear half sector portion of the slider pulley 104.

Preferably, idle rollers 138, 140 are provided intermediate pulleys 114 and 130, being fixedly mounted to frame 86, for guiding cable 46 between pulleys 104 and 130. Thus, the following cable segments are defined in relation to the structure of the automatic pin resetting machine (FIG. 9*a*)

(a) a first cable segment, 46*a*, extending between the pin head socket 48 and the bore 66 of lower panel 54, the inclination of segment 46*a* being variable;

(b) a second, interpanel segment 46*b*, extending between panels 52 and 54, segment 46*b* remaining substantially vertical with a slight rearward, downward inclination in FIG. 9*a* having been exaggerated for clarity of the view;

(c) a third, forwardly upwardly inclined cable segment 46*c*, joining the upper rearward sector portion of pulley 80 to the frontward half sector portion of pulley 92;

(d) a fourth, substantially horizontal cable segment 46*d*, joining pulley 92 to the rearward half sector portion of slider pulley 104, and extending over leg 46*c*;

(e) a fifth, substantially horizontal cable segment 46*e*, joining slider pulley 104 to the bottom sector portion of the idle pulley 138 proximate to slider pulley 104; and (f) a last, forwardly upwardly inclined cable segment 46*f*, joining roller 138 to pulley 108 and slidingly abutting at its intermediate section against distal roller 140.

First cable segment 46*a* is vertical (FIG. 9), when pin 30 stands upright as part of the set of skittles arrangement on the skittle alley 24, but will become rearwardly downwardly inclined, when pin 30 is pushed rearwardly by ball 42 (FIG. 9*a*) and will disappear when pin 30 is lifted to engage panel 54 (FIG. 5). Second cable segment 46*b* will swing slightly between bores 66 and 68, during rearward motion of pin 30, but will generally remain vertical. The length of the fourth and fifth segments 46*d* and 46*e* will substantially change as a function of the relative position of the slider pulley 104 along its rail 112. The length of cable segment 46*f* will vary slightly, as a function of the angular value of pivotal motion of lever 126.

Cable locking means 142, detailed below, will advantageously be provided, to temporarily lock the cable 46 of a knocked down pin 30 already engaged into the perforated panel 54 (FIG. 5), so as to prevent that cable from yielding to the weight bias of that pin upon release of the cable pulling means 50. Locking means 142 is preferably mounted about cable segment 46*d*.

It is envisioned to provide an electronic control means, 144, for controlling operation of the automatic pin setting machine 20. Electronic control means 144 will include a central processing unit CPU, and:

(a) a control panel 146, including a display, and operated by the bowling room manager;

(b) a first motion sensor 148, mounted at the intersection of bowling lane 22 and skittle alley 24 and operatively connected by line 150 to control panel 146, and sensitive to a rolling ball 42;

(c) second and third motion sensors 152 and 154, mounted to frame 86 at opposite ends of rail 94, operatively connected to control panel 146 by lines 156 and 158, and sensitive to passge of a slider member 96; an electronic command line 160 operatively connecting control panel 146 to drive axle 118;

(d) an electronic line 162, interconnecting CPU 146 to cable lock means 142.

Bowling alley sensor 148 detects balls 42 rolling on alley 22. The bowling alley motion sensor 148 then sends a signal to a timer in the CPU 144: if within a set period of time, for example a few seconds and preferably 2.4 seconds, no pin 30 is struck (as per a pin strike detection means 234–238 connectd to CPU 144 and detailed later), no signal is sent by the CPU 144. On the other hand, if one or more pin 30 is knocked down by a ball 42, a signal is sent by the CPU to the cable pulling means 50, which lifts all the pins 30 by displacing all slider pulleys 104 to the right of FIGS. 9–9*a*. If slider 96 does not reach rear sensor 154 within a set time period, this may be indicative that some cables 46 have become entangled with one another. An electromagnetic clutch 211 (detailed below) is triggered via line 161, is then unclutched, to reverse the motion of slider 96 to the left, toward first sensor 152, whereby pins 30 are lowered. Once fore sensor 152 is reached, CPU 144 sends another signal to another clutch 209 via line 163, to reverse the motion of slider 96. Reciprocating motion of slider 96, and thus of cables 46, continue until the cables 46 are released from one another, as evidenced by the fact that slider 96 reaches a rearmost optical sensor 154. Sensor 154 then sends a signal to a timer in CPU 144 which, after a set period of time, e.g. four seconds, will lower only those pins 30 that were not struck by the ball 42.

Bowling alley sensor 148 also counts the number of ball throws. After a predefined number of throws, usually three, have been registered, CPU 144 triggers drive axle 118 through line 160 to actuate slider 96, to slide rearwardly along rail 94, so as to pull up all pins that remain in standing position onto flooring 24, to engage perforated plate 52.

Figure 13:
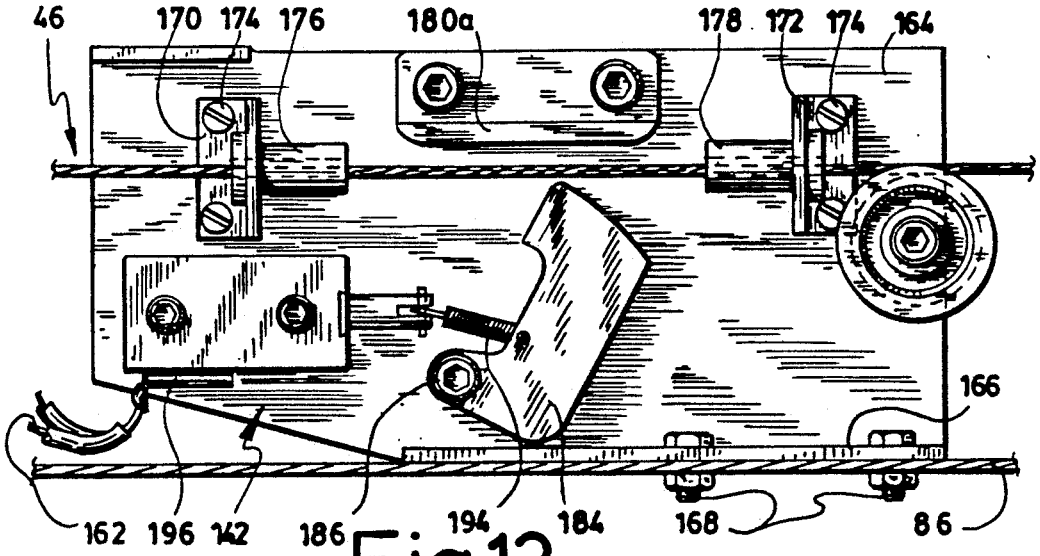
Figure 13A:
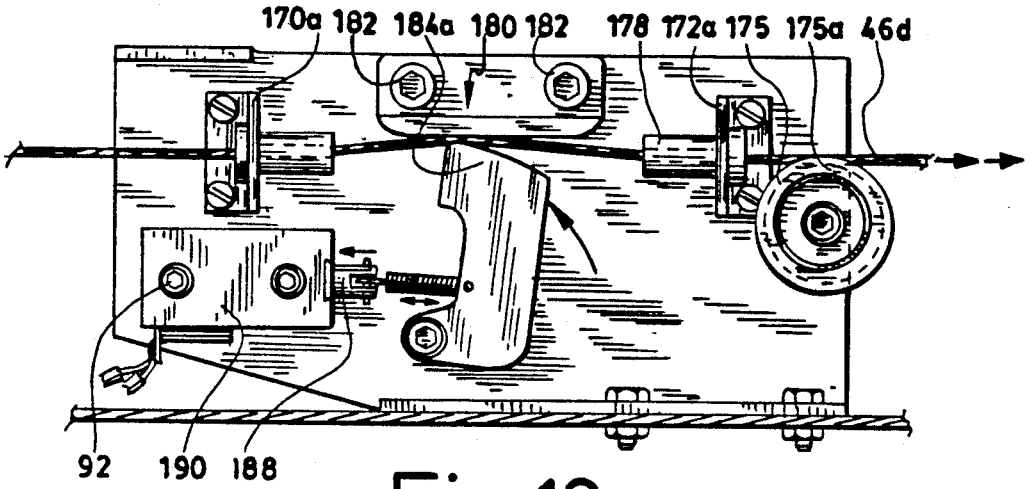
FIG. 13*a*, on the ninth sheet of drawings, is a view similar to FIG. 13 but showing the cable of a knocked down pin being locked in position by the plunger operated, friction lock pivotal wedge lever.

Cable locking means 142 is illustrated in FIGS. 13–13*a* to consist of an anchor plate 164, one for each cable, and fixedly secured at flange 166 by bolts 168 to main frame 86 intermediate front pulley 92 and rear block 114. Two cross-sectionally L-shape, fore and aft brackets 170, 172 are anchored by screws 174 to plate 164. Two hollow unthreaded bolt members 176, 178 are coaxially fixedly mounted through the transverse leg 170*a*, 172*a* of brackets 170, 172 respectively, for sliding through passage of a corresponding cable 46. A guiding roller 175 is preferably mounted rotatably to housing 164, with its rim 175*a* tangentially registering at its top section with the portion of cable 46*d* proximate collar 178 on the side thereof opposite collar 176. Roller 175 supports and guides cable 46 through channels 176 and 178, so as to prevent undesirable shearing action of the end edges of bushings 176, 178 against cable 46. Preferably, plate 164 is vertical and legs 170*a* and 172*a* , vertical and orthogonal relative to plate 164. A large bracket 180 is further anchored by adjustable bolts 182 to main plate 164, above cable 46, proximate thereto, between smaller brackets 170, 172. Cross-sectionally L-shape bracket 180 defines a transverse leg 180*a*, orthogonal to plate 164 and to the planes bracket legs 170*a*, 172*a*, and parallel to the portion of cable segment 46*d* extending between sleeves 176 and 178. An elongated wedge lever 184 is pivotally mounted at 186 to plate 164, in vertical register with large L-bracket 180 below cable 46*d*. Wedge lever 184 is pivotally mounted at 186 to plate 164, in vertical register with large L-bracket 180 below cable 46*d*. Wedge lever 184 defines a free swinging end 184*a* destined to pivotally engage a cable section 46 (FIG. 13*a*) when extending transversely to L-bracket 180, and to frictionally forcibly releasably lockingly taking in sandwich that cable section 46*d* with bracket seat 180*a* to lock the cable against seat 180*a* wedgingly to temporarily prevent axial sliding motion of cable 46.

Preferably, pivotal action of wedge lever 184 is controlled by a plunger 188 reciprocatable about an axis substantially parallel to cable segment 46*d*. Plunger 188 is carried by a housing 190, anchored by bolts 192 to plate 164 in underlying register with bracket 170. A coil spring 194 interconnects the outer end of plunger 188 to an intermediate section 184*b* of elongated lever 184. An electromagnetic actuator 196, physically anchored to plunger housing 190 and operatively connected to plunger 188 and to CPU 144 through electric command line 162, is destined to trigger retraction or extension of plunger 188. It is understood that retraction of plunger 188 will pivot lever 184 counterclockwise (sequence of FIGS. 13–13*a*) and will thus bias wedge lever seat 184*a* to wedgingly lockingly frictionally engage cable 46*d* lockingly against wall 180*a*, in the direction of cable release upon a pin 30 having been struck by a ball 42. Upon a voltage being applied to selected electro-magnet within casings 190, after a signal from CPU 144 following lifting of all pins 30 to their top limit position of FIG. 5, the corresponding plungers 188 will be pulled to apply and sustain a pulling force about lever 184 to wedgingly lock the corresponding cable 46 between seats 184*a* and 180*a*. Voltage is applied only to those electromagnetics 190 corresponding to each of the cables 46 at which ends a pin 30 has been struck and knocked down by a ball 42.

FIGS. 9*b*–9*c* and 6–8 detail the drive means 200 for entraining slider driving chain 112. Drive means 200 includes two parallel shafts 202, 204 rotatively mounted to the casing side walls 86*b*, 86*b* by end anchor sleeves 206. A constant-speed electrical motor 208 entrains upper shaft 202 through electromagnetic clutches 209 and 211 (via lines 161 and 163) and gear reductor 210. Motor 208 is connected to line 160. Chain 120 meshingly engages gears 116, 118 being axially anchored to one end section of shafts 204, 202 respectively. Hence, actuation of motor 208 entrains shafts 202, 204 in rotation. A torque clutch 212 is mounted to an intermediate section of lower shaft 204, to prevent transmission of a axle power to chain 112 in case of overload, as during cable entanglement between the pins 30 and the anchor point 124.

To the ends of shafts 204, 202 opposite gears 116 and 118, are mouted two additional gears 214, 216 respectively. Two additional short shafts 218, 220 are anchored at one end to the casing rear wall 86*d*, by transverse bracket 22, and extend parallel to shafts 202, 204 in register with gears 214, 216 and are also anchored at the opposite end to the proximate casing side wall 86*b*. Two wide gear wheels 224 and 226 are carried by short shafts 218, 220, for free rotation thereabout, gear wheels 224 and 226 meshing with one another about a fraction of their width. Transmission chain 228 meshingly interconnects the free width portion of gear 224 with gear 214, and transmission chain 230 meshingly interconnects the free width portion of gear 226 with gear 216. Thus, gear assembly 224, 226 reverse the direction of rotation of one shaft 202 relative to the other shaft 204. A second torque clutch 232 is mounted to shaft 204 between gear 216 and the wall 86*b*, in register with gears 224 and 226.

Figure 16:
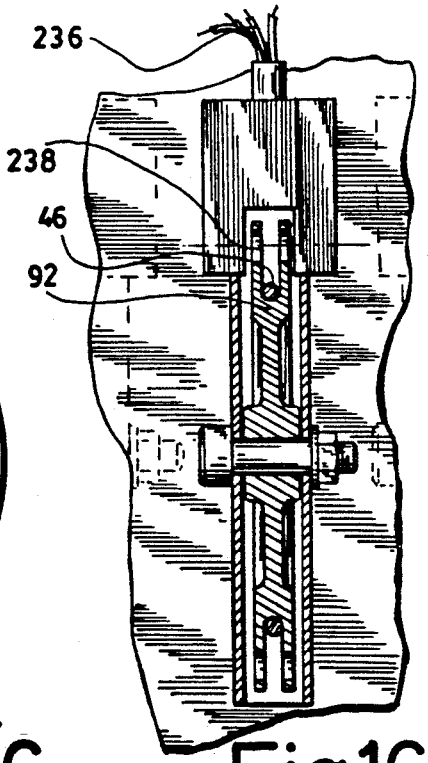
FIG. 16, on the eighth sheet of drawings, is a sectional view taken along broken lines 16—16 of FIG. 12.

Preferably, an optical sensor 234 (FIGS. 12 and 16) is mounted to each one of the ten front pulleys 92, one for each of the tenpins 30, at the periphery thereof, and connected to the CPU 144 by an electric line 236, again one for each sensor 234. The peripheral section of each pulley 92 includes a plurality of transverse through-bores 238. Thus, rotation of a given pulley 92 indicating that the corrresponding pin 30 at the end of the corrresponding cable 46, has been struck by a ball 42, will be registered and put into the memory of CPU 144, as well as displayed onto a display window, through its line 236, for informative display to the players. Preferably, upon pulley 92 rotating (under bias from cable 46) so that no more than two bores 238 come in register with the optical sensor 234, in a single rotational motion thereof, no electronic order will be sent by the CPU 144, accordingly with its embedded software. On the other hand, if pulley 92 rotates continuously sufficiently for three or more peripheral bores 238 to be scanned by the optical sensor, the CPU 144 will register such rotation of the pulley 92 as an indication of the corresponding pin 30 having been knocked down on the skittle alley 24.

In operation:

(a) in FIG. 9, all tenpins 30 stand upright on flooring 24. Each slider 96 is located adjacent the fore optical sensor 152, and cable sections **46*d* and 46*e*, extend rearwardly beyond their slider pulleys 104 but ends forwardly of block tip 129, to define a rearward slack loop 46'. (The shape of loop 46' illustrated in FIG. 9 suggests that cable 46**, although flexible retains substantial sturdiness).

(b) in FIG. **9*a*, upon ball 42 striking at least one pin 30, say pin 30-1, the corresponding cable 46-1 will be pulled, and the corresponding front pulley 92-1 will rotate. CPU 144 will thus identify which pin has been knocked down, through corresponding optical sensor 234-1 and line 236-1, by correlating the pulley to the corresponding pin. The slack loop 46' of that cable 46-1** will thus disappear.

(c) in FIG. **9*b*, after a time lapse monitored by the timer 145 in CPU 144, drive axle 118 will be triggered through line 160 to bring cable 46-1 back first to its initial position in (a), by actuating chain 110 in counter-clockwise rotation, to move slider 96—and thus cable carrying pulley 104—rearwardly. During this portion of travel of slider 96, the remaining nine cables 46 do not bulge, because their too have a rearward slack loop 46' along which these cables pulleys 92 will freely slide. However, as soon as slider 96 is carried by chain 112 rearwardly beyond block tip 129, all cables 46 will be pulled therewith. That is to say, all tenpins 30 will be lifted to their plate engaging position shown in FIG. 5, well above flooring 24. (d) FIG. 9*c*: upon timer coupled optical sensor 154 and associated chain drive motor coupled optical sensor having detected the passage of slider 100, a stop signal is sent by CPU 144 through line 160 to electric motor 208, to stop rotation of chain 112 and thus, rearward motion of slider 100. After a given delay computed by CPU timer 145, motor 208, 210 is again triggered in reverse, to bring back slider 100 to its initial position in (a) by clockwise rotation of chain 112. During this step, all pulleys 104, but for pulley 104-1, will return to their initial position with the slider 96 in register with the fore sensor 152. Indeed, CPU 144 will have directed plunger 188-1 of cable lock means 142-1 to bias lever 184 to frictionally wedgingly anchor cable 46-1 of the knocked down pin 30-1 to bias lever 184 to frictionally wedgingly anchor cable 46-1 against seat 180*a*-1, thus preventing that single knocked-down pin 30-1 from descending to the skittle alley flooring 24 by its own weight. Hence, that cable slack loop 46'' will be more considerable than was the case initially, as suggested in FIG. 9*c*, extending rearwardly beyond block 123 in register with aft sensor 154. Pulley 104-1 will thus smoothly slide along the upper and lower runs of cable 46-1**.

The present pin setter can be used for a variety of bowling games, including duckpin, fivepin, hard duck and tenpin.

I claim:

1. An automatic, tethered pin setter for a game of bowling in which a number of pins upstanding on a skittle alley flooring are targeted by a ball thrown thereat rollingly along a bowling alley, said pin setter comprising:

(a) a main fixed frame;

(b) a number of flexible cables, each cable connected at one end to a corresponding one of said pins and at the other end to said main frame at an anchor member;

(c) cable pullng means, to pull said tethered pins away from a first, skittle alley standing position, to a second, skittle alley clearing position;

(d) resetting means, for returning at least some of said tethered pins from their second to their first position, upon deactivation of said cable pulling means;

(e) cable lock means, deactivating said resetting means selectively only for those tethered pins which were knocked down by the ball throw exclusively of those tethered pins which were still standing on the skittle alley flooring after the ball throw;

(f) power means, to power operate said cable pulling means;

(g) sensor means, to collect data as to what and how many tethered pins were knocked down; and (h) computer means, to correlate said sensor means, power means, cable lock means and cable pulling means to enable said cable lock means to segregate those cables of knocked-down pins from those cables of non knocked-down pins;

wherein said cable pulling means includes a slider member, mounted to a rail member being anchored in horizontal position to said main frame, reversible drive means to reciprocate said slider member along said rail member, a number of idle pulleys each rotatably mounted to said single slider member by a corresponding yoke assembly, each cable rollingly engaging a corresponding one of said idle pulleys, an anchor member anchored to said main frame downstream of said idle pulleys relative to said tethered pins, and limit sensors at the opposite ends of said rail member and sensitive to the passage of said slider member and operatively connected to said computer means for alternately actuating or deactivating said power means after correlating all data processed by said computer means.

2. An automatic tethered pin setter as defined in claim 1, wherein said power means includes a single speed motor driving said cables; further including an elongated block unit, mounted to said main frame and extending in underlying register with said rail member, and defining first and second opposite, inclined, top walls merging at an intermediate tip, each said block unit top wall forming a smooth, generally concave pattern, said slider member having a rocker arm anchored to said yoke assemblies and projecting therebeyond to engage said inclined block unit walls during reciprocating motion of said slider member; said rocker arm being spring biased in vertical position wherein said engagement of the rocker arm onto the inclined block unit walls is made against the rocker arm spring bias and thus progressively reduces the speed of displacement of said cables at each of the opposite end runs of said cables corresponding to said first and second positions respectively of said tethered pins.

* * * * *